United States Patent [19]

Belanger

[11] 4,055,919

[45] Nov. 1, 1977

[54] PACK UNIT AND MOUNTING MEANS THEREFOR

[75] Inventor: James A. Belanger, Northville, Mich.

[73] Assignee: Belanger, Inc., Northville, Mich.

[21] Appl. No.: 685,015

[22] Filed: May 10, 1976

[51] Int. Cl.[2] ..... B24D 13/06

[52] U.S. Cl. ..... 51/334; 15/230.19; 51/337; 51/394

[58] Field of Search ..... 51/334–337, 51/394; 15/183, 179, 230.14, 230.19

[56] References Cited

U.S. PATENT DOCUMENTS

| | | | |
|---|---|---|---|
| 3,058,269 | 10/1962 | Block | 51/337 |
| 3,798,847 | 3/1974 | Belanger | 51/337 |
| 3,846,942 | 11/1974 | Belanger | 51/334 |
| 3,879,903 | 4/1975 | Belanger | 51/337 |

*Primary Examiner*—Al Lawrence Smith
*Assistant Examiner*—Nicholas P. Godici
*Attorney, Agent, or Firm*—Cullen, Settle, Sloman & Cantor

[57] ABSTRACT

A pack unit adapted to be mounted on the hub structure of a rotary finishing wheel. The hub structure includes a plurality of circumferentially spaced, elongated slots about the periphery thereof and each of the slots has an inner portion, a restricted neck passage opening outwardly therfrom, and a longitudinal slot axis substantially parallel to the rotational axis of the finishing wheel. The pack unit includes at least one flap-like member of finishing material having a radially outer portion adapted for engaging a workpiece and a radially inner portion adapted to be clampably secured. The pack unit includes an improved mounting apparatus which includes a unitary, integrally-formed, elongated clip member which includes a clip body and a pair of radially outwardly extending clamping arms adapted for clampably receiving the radially inner portion of the flap-like member therebetween. The radially inner portion of the clip body is provided with an elongated, radially inwardly disposed slot having an inner portion and a restricted neck passage opening outwardly therefrom. The improved pack unit mounting apparatus includes a unitary link member having a first slot-engaging head portion adapted to be telescopically received within the elongated slot of the clip member, a second slot-engaging head portion adapted to be telescopically received within an elongated slot of the hub structure, and an intermediate portion integrally connecting the head portion. End segments of the intermediate link portion adjacent the head portions are adapted to be telescopically received within the restricted neck passages of the slots such that the link member telescopically and replaceably mounts the flap-like members to the hub structure for limited hinge-type pivotal movement about the slot axii.

25 Claims, 5 Drawing Figures

PACK UNIT AND MOUNTING MEANS THEREFOR

BACKGROUND OF THE INVENTION

1. Field of the Invention

The present invention relates to an improved pack unit for rotary finishing wheels and the like, and more particularly to an improved modular pack unit mounting means adapted to replaceably mount pack units having flap-like members of finishing material to a hub structure to form a finishing wheel.

The invention finds use in any type of rotary finishing wheel structure such as those employing abrasive sheets, bristles, or the like which are generally used for grinding, rough or finish abrasive working, brushing, burnishing, or the like. However, in the preferred embodiment of this invention, the improved pack units are employed in commercial automotive car washing establishments and are replaceably mountable to finishing wheels structures which would normally employ cloth, cloth-like material, felt-like material, or the like for use in washing, drying, buffing, polishing, or otherwise finishing the car. Additionally, the pack units of this invention may include any other type of conventional finishing material such as sewed sisal, pex, horsehair, leather or the like.

2. Description of the Prior Art

My own U.S. Patents are typical of the rotary finishing wheel structures and pack units of the prior art to which this invention relates and the numbers and issue dates of those patents are as follows: U.S. Pat. Nos. 3,455,068, July 15, 1969; 3,535,833, Oct. 27, 1970; 3,621,622, Nov. 23, 1971; 3,626,646, Dec. 14, 1971; 3,685,217, Aug. 22, 1972; 3,768,214, Oct. 30, 1973; 3,772,833, Nov. 20, 1973; 3,798,847, Mar. 26, 1974; 3,800,481, Apr. 2, 1974; 3,807,099, Apr. 30, 1974; 3,813,829, June 4, 1974; 3,820,291, June 28, 1974; 3,842,547, Oct. 22, 1974; 3,914,908, Oct. 28, 1975; and Re 28,118, Aug. 20, 1974. In so much that these patents teach various rotary finishing wheels, hub structures, and applications for rotary finishing wheels and pack units, they are incorporated by reference herein.

Generally, the pack units of the prior art have been replaceably attached to a finishing wheel structure by sliding an elongated rod through a clamp member fastened to the finishing material portion of the pack unit or through a bight portion of one or more plies of the pack unit itself. The bight portion often contains a cylindrical rod-receiving tube or U-shaped rod-receiving member. While a few of the pack units of the prior art are adapted to directly engage a slot on the periphery of the wheel, such pack units normally require complex external clamping members having a first clamping member for engaging the slot and a second complex clamping member for securing the flap-like plies of finishing material together. Furthermore, these complex structures often require a supplemental support rod for mounting, and are relatively expensive and difficult to assemble, remove and replace.

The improved modular pack unit of the present invention employs a relatively inexpensive, easy-to-install, remove, and replace pack-mounting assembly having an extremely simple construction.

SUMMARY OF THE INVENTION

The improved hinge-type, slot-engaging modular pack unit of the present invention is a relatively inexpensive, easy-to-install, remove, and replace pack unit which is adapted to be mounted to the hub structure of a rotary finishing wheel without the use of insertable rods or complex internal and external clamping mechanisms.

The improved pack unit of the present invention is adapted to be mounted on a hub structure for forming a rotary finishing wheel. The hub structure is adapted to be mounted to a shaft for rotation therewith about its rotational axis. The hub structure is provided with a plurality of circumferentially spaced, quasi-cylindrical, key-hole-type, slot-defining formations about the periphery thereof. These formations define elongated slots having a longitudinal slot axis parallel to the rotational axis of the hub structure, a quasi-cylindrical interior portion, and a restricted neck passage opening outwardly therefrom.

At least one pack unit is adapted to be mounted in each of the slots of the hub structure for hinge-type limited pivotal movement about the slot axii. Each pack unit includes at least one, and preferably several, flap-like members of finishing material having a radially outer portion adapted for engaging a workpiece and a radially inner portion adapted to be clampably secured.

The improved pack-mounting apparatus of this invention includes a unitary, integrally-formed, elongated clip member including a clip body and a pair of radially outwardly extending clamping arms adapted for clampably receiving the radially inner portion of the flap-like members therebetween. The radially inner portion of the clip body is provided with an elongated, radially inwardly disposed spot having an inner portion and a restricted neck passage opening outwardly therefrom. The pack unit-mounting assembly also includes a unitary link member having a first slot-engaging head portion adapted to be telescopically received within the elongated slot of the clip member, a second slot-engaging head portion adapted to be telescopically received within an elongated slot of the hub structure, and an intermediate portion integrally interconnecting the head portions. The end segments of the intermediate link portion adjacent each head portion is adapted to be telescopically received within the restricted neck passages of the slots so that the link member telescopically mounts the flap-like members to the hub structure.

In the preferred embodiment, the link member has a dumb-bell-shaped cross sectional configuration when viewed along a section taken perpendicular to the rotational axis. The first and second head portions are quasi-cylindrical in shape and are adapted to be telescopically and matedly received within the quasi-cylindrical interior portion of the slots for axial movement therein for assembling, removing and replacing the pack units.

In this invention, the flap-like members of finishing material have their radially inner portion received between the two clamping arms of the clip member and permanently secured therebetween in a sandwiched fashion. The modular pack units of this invention include the pack unit-mounting means and the members of finishing material. The modular combination of the clip member which is permanently fastened to the radially inner portion of the flap-like members is the modular unit which would normally be replaced when one or more of the flap-like members became worn, soiled, or otherwise damaged.

Therefore, the radially outer head portion of the link member would normally be removeably retained axially within the elongated slot of the clip member. This would enable the modular clip member flap-like member combination to be easily assembled, removed, and replaced, particularly if the link member is made of a yieldable material thereby making installation and replacement even less difficult.

Alternatively, the radially inner slot-engaging head portion of the link member can be removeably retained within the elongated slots of the hub structure so that the entire pack unit can be removeably replaceable. Still further, both of the head portions of the link member could be removeably retained within their respective slots for still greater versatility and ease of assembly, removal and replacement.

In the preferred embodiment disclosed herein, the link member is a single, unitary, integrally-formed piece of yieldable material, for example, a resilient plastic material such as polypropylene or the like, and the clip member is a single, unitary, integrally-formed piece of relatively rigid, light weight material, for example, an aluminum or plastic extrusion or the like. Additionally, the head portions of the link member may be provided with reenforcing rods if desired.

A major feature of the improved pack units of the present invention resides in the provision of a relatively inexpensive, mechanically simple, pack unit-mounting means whereby the modular flap-like members of finishing material may be easily and quickly installed, removed and replaced.

Other advantages and meritorious features of the present invention will be more fully understood from the following detailed description of the drawings and the preferred embodiment, the appended claims and the drawings which are described briefly hereinbelow.

DESCRIPTION OF THE PREFERRED EMBODIMENT

Figure 1:
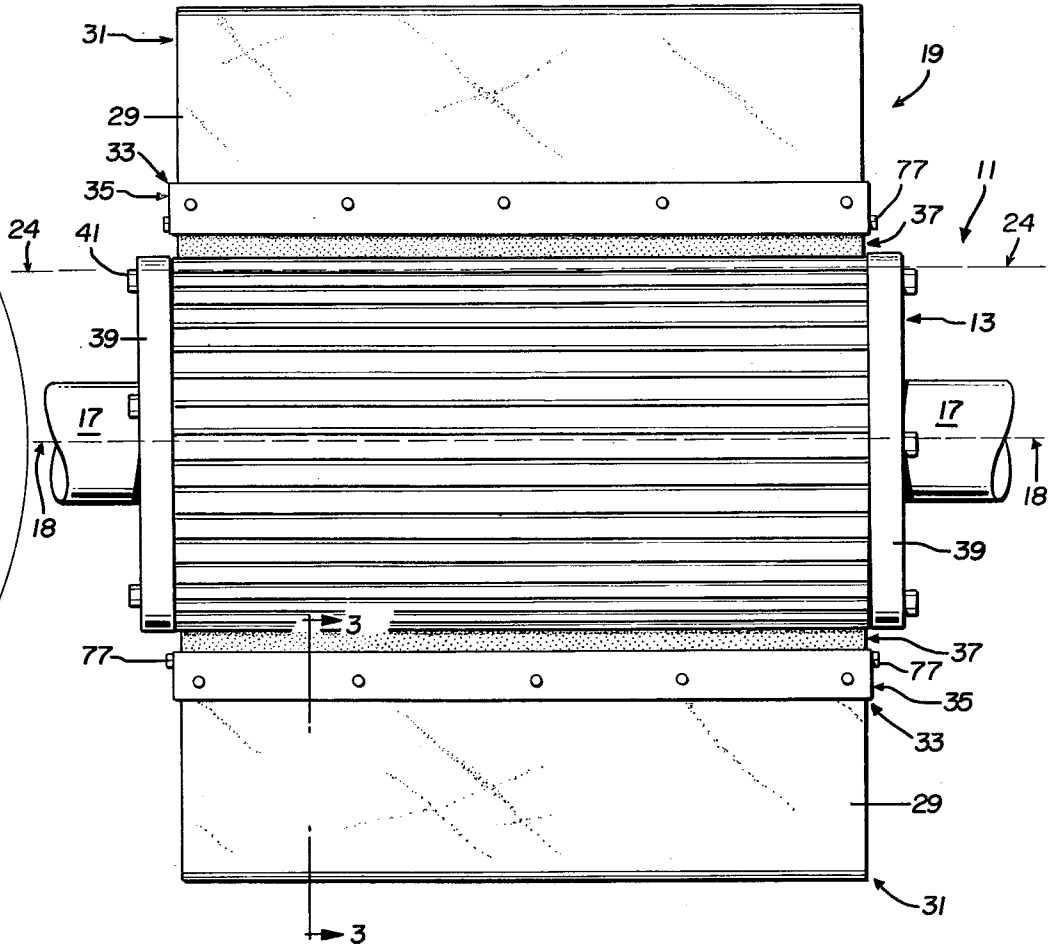
FIG. 1 is a fragmentary top view of the rotary finishing wheel of the present invention.
Figure 2:
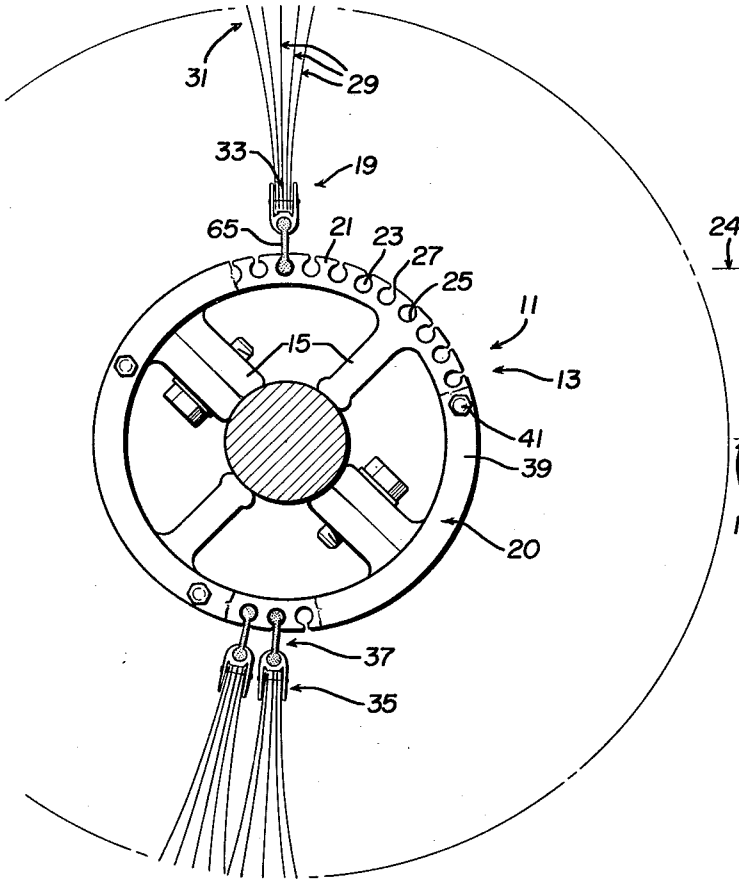
FIG. 2 is a fragmentary axial end view of the rotary feed wheel of FIG. 1 showing a hub structure secured to a shaft for rotation therewith and slots about the periphery of the hub structure for mounting the improved pack units of the present invention.

FIGS. 1 and 2 illustrate a rotary finishing wheel 11 which includes a generally cylindrical hub structure 13 having an inner clamping portion 15 adapted to clampably secure the hub structure 13 to a shaft 17 for rotation therewith. The rotational axis 18 of the rotary finishing wheel 11 and hub structure 13 is coincident with the rotational axis of the shaft 17. A plurality of replaceable, modular pack units 19 are mounted about the periphery of the hub structure 13 to form the finishing wheel 11.

For a more detailed description of the various hub structures useable with the improved pack units 19 of the present invention, reference is hereby made to my copending patent application Ser. No. 684,440, which was filed on May 10, 1976, now U.S. Pat. No. 4,018,014 for an Improved Hub Structure For Rotary Finishing Wheels. Briefly, the hub structure 13 used to illustrate the present invention includes a generally cylindrical, radially outer hub wall 20 having a plurality of circumferentially spaced, quasi-cylindrical, key-hole-type, slot-defining formations 21 about the radially outer periphery thereof. The formations 21 define a plurality of longitudinal slots 23, each of which includes a quasi-cylindrical interior portion 25 and a restricted neck passage 27 opening outwardly therefrom. The cylindrical hub wall 20 is clampably secured to the shaft 17 by the interior clamping portions 15 which are described more fully in the above-identified copending application.

Figure 3:
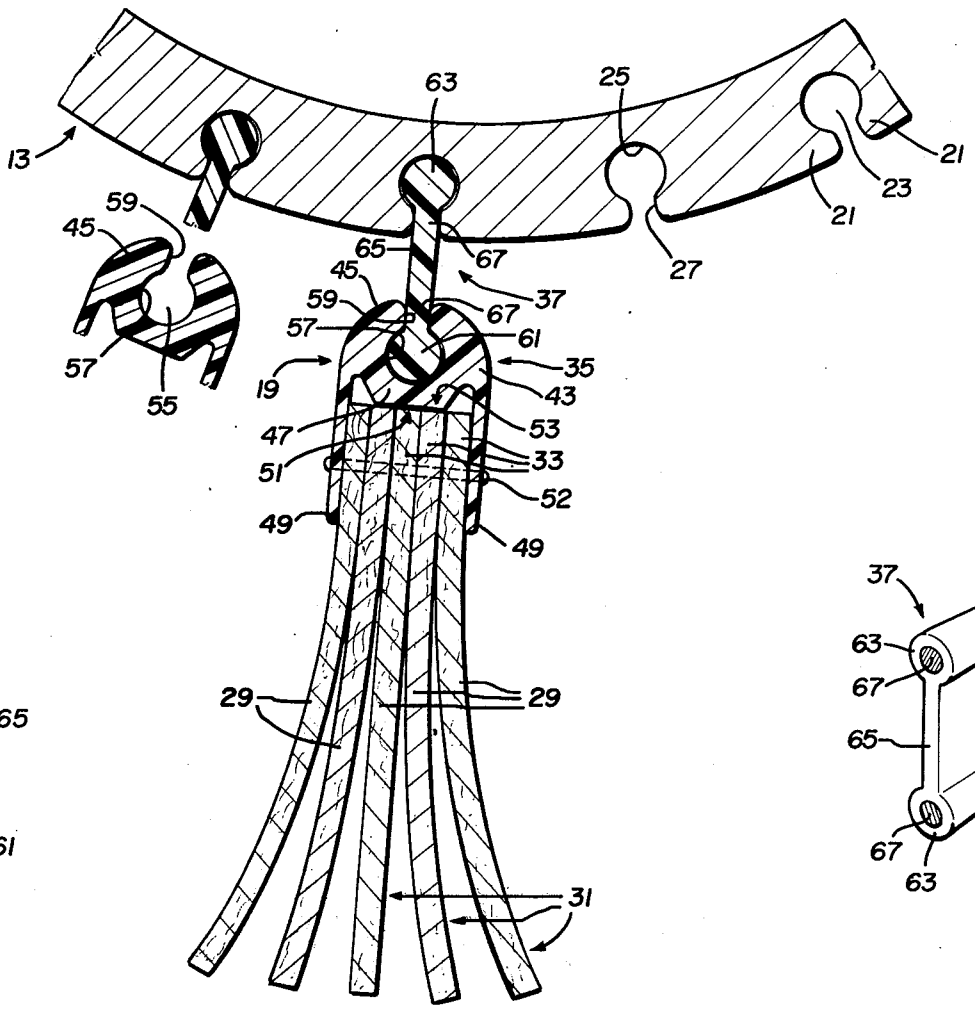
FIG. 3 is a sectional view, taken along lines 3—3 of FIG. 1, of a portion of the hub structure and one of the improved pack units of the present invention.

As further illustrated in FIGS. 1,2 and 3, the improved pack unit 19 of the present invention includes one or more flap-like members 29 of finishing material. Each of the flap-like members 29 includes a radially outer portion 31 adapted for engaging a workpiece and a radially inner portion adapted to be clampably secured permanently within a clip member 35. The flap-like members may be, for example, sheets or plies of cloth, cloth-like material, felt-like material or the like which are frequently employed in commercial automotive car washing establishments for use in washing, drying, buffing, polishing, or otherwise finishing a car. Alternatively, the flap-like members 29 could employ abrasive sheets, bristles, or the like which are generally used for grinding rough or finish abrasive working, brushing, burnishing, or the like, and in still other applications, the flap-like members could employ sewed sisal, pex, horsehair, leather or the like. The term "finishing" as used herein is used in a generic sense to refer to any of the types of operations cited above or referred to in my previously identified prior patents.

Each of the pack units 19 includes an elongated clip member 35 which is substantially coextensive in axial length with the elongated slots 23 of the hub structure 13. A link member 37 is used to replaceably mount the clip member 35 to the slots 23 of the hub structure 13 for limited hinge-type pivotal movement about the slot axii 24 which are parallel to the rotational axis 18. One head portion of the link member 37 is telescopically and slideably received within the slot 23 for relative axial motion in a direction parallel to the rotational axis 18 for installing, removing and replacing the pack unit 19. When the pack unit 19 is so installed, it is axially retained within the hub slots 23 by means of an end plate 39 which is secured to the ends of the hub structure 13 by bolts 41 or by similar, conventionally-known fastening means.

The pack unit 19 of the present invention will be described in more detail with reference to FIG. 3. The improved pack unit 19, which includes the flap-like members 31 of finishing material, the elongated clip member 35, and the elongated link member 37, represents a modular unit which is easily mounted to and removed from the individual slots 23 of the hub structure 13. Alternatively, the fixedly secured combination of the flap-like members 29 and the elongated clip member 35 can itself be a replaceable modular unit which can be telescopically mounted to and removed from the link member 37 for easy installation, removal, and replacement.

The clip member 35 includes a clip body 43 having a radially inner portion 45 and a radially outer portion 47.

A pair of clamping arms 49 integral with the radially outer portion 47 of the clip body 43 extend radially outwardly therefrom and are adapted to receive the radially inner portion 33 of the flap-like members 29 therebetween. The central section of the radially outer portion 47 which is disposed between the clamping arms 49 may be provided with an abutment surface 51 adapted to abuttedly engage the innermost ends 53 of the radially inner portion 33 of the flap-like members 29 thereagainst. When the radially intermost ends 53 of the flap-like members 29 are abuttedly disposed against the abuttment surface 51 and the radially inner portion 33 of the flap-like members 29 are disposed between the pair of clamping arms 49, a staple 53 or similar fastening means is used to fixedly or permanently secure the pair of clamping arms 49 and the radially inner portions 33 of the flap-like members 29 tightly together in a sandwiched fashion such that the combination of the elongated clip member 35 and the flap-like members 29 becomes a replaceable modular finishing unit.

The radially inner portion 45 of the clip member 35 is provided with an elongated, quasi-cylindrical, key-hole-type slot 55 having a quasi-cylindrical interior portion 57 and a restricted neck passage 59 opening outwardly therefrom. The slot 55 is adapted for mounting the modular unit comprising the fixedly secured combination of the clip member 35 and the flap-like members 29 to the hub structure 17 via the link member 37 for hinge-type limited pivotal motion about the slot axii 24. The elongated slot 55 of the elongated clip member 35 similarly has a slot axis which is parallel to the rotational axis 18 when the pack unit 19 is mounted to the hub structure 13.

In the preferred embodiment disclosed herein, the elongated clip member 35 is a single, unitary, integrally-formed piece of relatively rigid, light weight material such as an extruded plastic or aluminum member. In this embodiment the clip member 35 is substantially coextensive in length with the slots 23 of the hub structure 13.

The link member 37 of the present invention is a single, unitary, integrally-formed piece of yieldable material, for example, a resilient plastic such as polypropylene or the like. The link member 37 may also be coextensive in length with the slots 23 of the hub structure 13 and with the longitudinal length of the clip member 35, although the link members 37 may be slightly shorter for retaining purposes as hereinafter described.

The cross sectional configuration of the link member 37, taken along a plane perpendicular to the rotational axis 18, is a generally dumb-bell-shaped configuration having a first quasi-cylindrical head portion 61 adapted to be slideably received within the slot 55 of the elongated clip 35 for axial movement therein for assembling, removing and replacing the modular clip member flap-like member combination 35, 29, respectively. The link member 37 also includes a second quasi-cylindrical head portion 63 adapted to be slideably received within an elongated slot 23 of the hub structure 13 for axial movement therein to effect the assembly, removal and replacement of the pack unit 19 therefrom. Furthermore, the link unit includes an intermediate portion 65 integrally connecting the first head portion 61 with the second head portion 63. The intermediate portion 65 has its end segments 67 which are adjacent to the head portions 61, 63 adapted to be slideably received for axial movement within the restricted neck passages 27, 59 of the slots 23, 55 respectively.

When the improved pack unit 19 of the present invention is replaceably mounted on the hub structure 13 to form the finishing wheel 11, the first quasi-cylindrical head portion 61 is radially constrained within the quasi-cylindrical interior portion 57 of the clip member slot 55 by the restricted neck passage 59 and the second quasi-cylindrical head portion 63 is radially constrained within the quasi-cylindrical interior portion 25 of the hub slot 23 by the restricted neck passage 27 thereby allowing the intermediate portion 65, which extends radially outwardly through the restricted neck passages 27, 59, to interconnect the head portions 63, 61 respectively, thereby mounting the pack unit 19 to the hub structure 13 to achieve the desired hinge-type limited pivotal motion about the slot axii 24.

As previously described, the entire pack unit 19 which includes the link member 37, the clip member 35, and the flap-like members 29 may be removeably retained within the slots 23 of the hub structure 13 as by the end plates 39 and bolts 41 or some similar restraining means or, alternatively, the modular replacement unit comprising the clip member 35 and the fixedly attached flap-like members 29 of finishing material may be removeably retained on the first quasi-cylindrical head portion 61 of the link member 37 as hereinafter described. Still further, the first portion 61 can be removeably retained within the slot 55 while the second head portion 63 is fixedly retained within the slot 23; the first head portion 61 can be fixedly retained within the slot 55 while the second head portion 63 is removeably retained within the slot 23; or both of the head portions 61, 63 can be removeably retained within the slots 55, 23, respectively.

Figure 4:
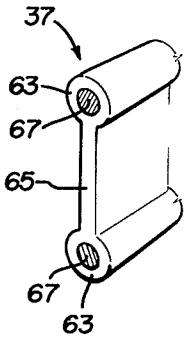
FIG. 4 is a fragmentary perspective view of an alternate embodiment of the link member of the present invention.

FIG. 4 shows an alternate embodiment to the link member 37 of FIG. 3 wherein each of the first and second head portions 61, 63 are provided with a relatively rigid, cylindrical rod member 67 extending the axial length thereof and generally parallel to the slot axis 24 when the pack unit 19 is mounted on the hub structure 13. The rods 67 are provided for reinforcing and support purposes. As previously described, the intermediate portion 65 may be yieldable or bendable to aid in the hinge-type pivotal motion of the pack unit 19 and for ease in handling the link member 37 for installing, removing and replacing the entire pack unit 19 or the modular replacement portion comprising the fixedly secured combination of the clip member 35 with the flap-like members 29.

Figure 5:
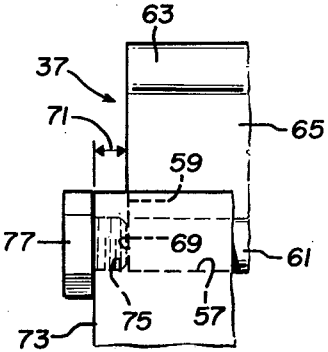
FIG. 5 is a perspective end view, partially in section of a portion of the clip member and link member combination of the present invention illustrating a means for removeably retaining the link member within the clip member slot.

FIG. 5 shows one embodiment of a means for removeably retaining the first quasi-cylindrical head portion 61 within the elongated slot 55 of the clip member 35. The link member 37 has the intermediate portion 65 integrally interconnecting the second slot-engaging head portion 63 with the first slot-engaging head portion 61. The head portion 61 is radially constrained within the quasi-cylindrical interior 57 of the clip slot 55 by the restricted neck portion 59.

The link member 37 is telescopically and slideably received within the clip slot 55 an axial distance 71 from the axial end 73 of the clip member 35. The quasi-cylindrical interior portion 57 of the clip member slot 55 adjacent the axial end 73 is internally threaded as indicated by the reference numeral 75. A bolt-like, externally-threaded fastening element 77 is threadedly received within the internally threaded portion 75 of the clip slot 55 adjacent the axial end 73 and threaded axially therein until the distal end 79 of the bolt-like element 77 retainably abutts the axial end 67 of the first quasi-cylindrical head portion 61 of the link member 37 so as to removeably retain the head portion 61 within the slot 55 as previously described.

The bolt-like element 77 may be removed to allow the head portion 61 to slideably axially removed and a replacement unit to be installed and again retainably secured thereon. A similar retaining means may be provided at the opposite axial end of the clip member 35, or one end of the clip member 35 may have its slot permanently closed by a plug member or the like as taught in the previously identified copending application.

The relatively low cost of the pack unit of the present invention and the extreme ease with which the entire pack units themselves or the replacement units may be assembled, removed, and replaced renders the present invention a significant step forward in the art. Since the link member 37 may be yieldable or bendable, it can be easily handled after it has been mounted to the hub structure to facilitate replaceably mounting the clip member/ flap-like member replacement unit combinations with a minimum of effort.

With this detailed description of the specific apparatus used to illustrate the prime embodiment of the present invention and the operation thereof, it will be obvious to those skilled in the art that various modifications can be made in the structure, materials and usages recited herein without departing from the spirit and scope of the present invention which is limited only by the appended claims.

I claim:

1. A pack unit adapted to be mounted on the hub structure of a rotary finishing wheel, said hub structure including a plurality of circumferentially spaced, elongated, quasi-cylindrical, key-hole-type slots about the periphery thereof, each of said slots having an inner portion and a restricted neck passage opening outwardly therefrom, each of the said slots further including a longitudinal slot axis substantially parallel to the rotational axis of said finishing wheel, said pack unit comprising at least one flap-like member of finishing material having a radially outer portion adapted for engaging the workpiece and a radially inner portion adapted to be clampably secured; a unitary, integrally-formed, elongated clip member including a clip body, a pair of radially outwardly extending clamping arms adapted for clampably receiving the radially inner portion of said flap-like member therebetween, the radially inner portion of said clip body being provided with an elongated, radially inwardly disposed, quasi-cylindrical, key-hole-type slot having an inner portion and a restricted neck passage opening outwardly therefrom; and a unitary link member having a dumb-bell-shaped configuration and having a first slot-engaging solid head portion of generally quasi-cylindrical configuration telescopically received within the elongated slot of said clip member, a second slot-engaging solid head portion of generally quasi-cylindrical configuration adapted to be telescopically received within an elongated slot of the hub structure, and an intermediate link portion integrally interconnecting said solid head portions, the end segment of said intermediate link portion adjacent said first head portion being telescopically received within the restricted neck passage of said slot in said clip body and the end segment of said intermediate link portion adjacent said second portion being adapted to be telescopically received within the restricted neck passage of the selected slot in the hub structure, such that said link member telescopically mounts said clip member carrying said flap-like member to the hub structure.

2. The pack unit of claim 1 further characterized in that said link member is a unitary, integrally-formed piece of yieldable material.

3. The pack unit of claim 2 further characterized in that said link member is substantially solid.

4. The pack unit of claim 3 further characterized in that said yieldable material is a resilient plastic.

5. The pack unit of claim 4 further characterized in that said yieldable material is a polypropylene extrusion.

6. The pack unit of claim 2 further characterized in that said link member is a single unbroken piece which extends substantially the entire axial length of the hub structure slots.

7. The pack unit of claim 6 further characterized in that said clip member is a unitary, integrally-formed piece which extends substantially the entire axial length of the hub structure slots.

8. The pack unit of claim 1 further characterized in that at least one of said first and second slot-engaging head portions of said link member is adapted to be telescopically received within its respective slot for sliding movement in a direction parallel to said rotational axis to effect the assembly, removal and replacement of said pack unit.

9. The pack unit of claim 1 further characterized in that said first head portion is removably retained axially within the elongated slot of said clip member.

10. The pack unit of claim 8 further characterized in that said first head portion is removably retained axially within the elongated slot of said clip member.

11. The pack unit of claim 8 further characterized in that one of said first and second head portions is adapted to be removeably retained axially within its respective slot and the other of said first and second head portions is adapted to be fixedly retained axially within its respective slot.

12. The pack unit of claim 1 further characterized in that said clip body has its radially outer portion disposed between said outwardly extending clamp arms adapted to abuttedly receive the innermost end of said radially inner portion of said flap-like member thereagainst when said radially inner portion is clampably and permanently secured between said clamping arms.

13. The pack unit of claim 1 further characterized in that said intermediate portion of said elongated, dumb-bell-shaped link member comprises a yieldable material which is bendable.

14. A pack unit adapted to be mounted on the hub structure of a rotary finishing wheel, said hub structure including a plurality of circumferentially spaced, elongated slots about the periphery thereof, each of said slots having an inner portion and a restricted neck passage opening outwardly therefrom, each of said slots further including a longitudinal slot axis substantially parallel to the rotational axis of said finishing wheel, said pack unit comprising at least one flap-like member of finishing material having a radially outer portion adapted for engaging a workpiece and a radially inner portion adapted to be clampably secured; a unitary, integrally-formed, elongated clip member including a clip body, a pair of radially outwardly extending clamping arms adapted for clampably receiving the radially inner portion of said flap-like member therebetween, the radially inner portion of said clip body being provided with an elongated, radially inwardly disposed slot having an inner portion and a restricted neck passage opening outwardly therefrom; and a unitary link member having a first slot-engaging solid head portion telescopically received within the elongated slot of said clip member, a second slot-engaging solid head portion adapted to be telescopically received within an elongated slot of the hub structure, and an intermediate portion integrally interconnecting said head portions, the end segment of said intermediate link portion adjacent said first head portion being telescopically received within the restricted neck passage of said slot in said clip body and the end segment of said intermediate link portion adjacent said second head portion being adapted to be telescopically received within the restricted neck passage of the selected slot in the hub structure such that said link member telescopically mounts said clip member carrying said flap-like member to the hub structure, at least one of said first and second slot-engaging head portions of said link member is adapted to be telescopically received within its respective slot for sliding movement in a direction parallel to said rotational axis to effect the assembly, removal and replacement of said pack unit, said second head portion is adapted to be removably retained axially within an elongated slot of the hub structure, both the elongated slots of the hub structure and the elongated slot of said clip member are key-hole-type formations whose inner portions are quasi-cylindrical in configuration and wherein said link member has a dumb-bell-shaped cross-section, said first and second slot-engaging head portions having a corresponding quasi-cylindrical shape adapted to be matedly received in their respective slots, each of said first and second quasi-cylindrical, slot-engaging head portions includes an elongated re-enforcing rod centrally disposed therein with the longitudinal axii of said rods being parallel to said slot axii.

15. The pack unit of claim 14 further characterized in that each of said rods is a solid rigid member and the quasi-cylindrical head portion encircling each of said rods is a yieldable material affixed tightly thereto, said intermediate portion of said link member being of the same yieldable material and being integral with said head portions to define a unitary, reenforced link member.

16. In a rotary finishing wheel having a hub structure adapted to be mounted to a shaft for rotation therewith, said shaft having a rotational axis and said hub structure being provided with a plurality of circumferentially spaced, quasi-cylindrical, key-hole-type, slot-defining formations about the periphery thereof, each of the defined elongated slots having a longitudinal slot axis parallel to said slot axis, and a plurality of modular and replaceable pack units mounted to said hub structure, each of said pack units including at least one flap-like member of finishing material having a radially outer portion adapted to engage a workpiece and a radially inner portion, an improved pack unit mounting means for each of said pack units comprising an elongated clip member having means disposed adjacent the radially outer portion thereof for fixedly securing said radially inner portion of said flap-like member to said clip member and means disposed adjacent the radially inner portion thereof for defining a quasi-cylindrical, key-hole-type, elongated slot having an axis generally parallel to said rotational axis; and an elongated link member having a dumb-bell-shaped configuration as viewed on a cross-section taken perpendicular to said rotational axis, said link member having a first solid head portion of generally quasi-cylindrical configuration slidably received within the slot of said elongated clip member for axial movement therein for assembling, removing, and replacing said clip member and the flap-like member fixedly secured thereto, a second oppositely disposed solid head portion of generally quasi-cylindrical configuration slidably received within an elongated slot of said hub structure for axial movement therein for assembling, removing, and replacing said pack unit, and an intermediate link portion connecting said first and second head portions.

17. The improved finishing wheel of claim 16 wherein said slots of said hub structure and said pack units each have a quasi-cylindrical interior portion and a restricted neck passage opening outwardly therefrom and wherein said link member is a unitary, integrally-formed member, said first and second head portions of quasi-cylindrical configuration are matedly and telescopically received within the corresponding quasi-cylindrical interior portions of their respective slots, and wherein said intermediate link portion integrally interconnecting said head portions includes segments adjacent to said head portions which are slideably received within the restricted neck passages of corresponding slots and extend outwardly therefrom for interconnecting said head portions even when they are radially constrained within said quasi-cylindrical slot-interiors.

18. The improved finishing wheel of claim 17 further characterized in that said link member is a single, unitary, integrally-formed piece of yieldable material substantially coextensive in axial length with the slots of said hub structure.

19. The improved finishing wheel of claim 18 further characterized in that said yieldable material is a resilient plastic extrusion.

20. The improved finishing wheel of claim 18 further characterized in that said clip member is a single, unitary, integrally-formed piece of relatively rigid material substantially coextensive in axial length with said link member.

21. The improved finishing wheel of claim 20 further characterized in that said integrally-formed piece of relatively rigid material is a unitary aluminum extrusion.

22. The improved finishing wheel of claim 16 further characterized in that said clip member is a single, unitary, integrally-formed member having a clip body, said means for fixedly securing includes a pair of radially outwardly extending clamping arms integral with the radially outer portion of the clip body, the radially inner portion of said flap-like member being received between said clamping arms so as to abut said radially outer portion of said clip body, and fastening means for penetrating said clamping arms and the radially inner portion of said flap-like member disposed therebetween for fixedly securing same together in a sandwiched fashion, and said slot-defining means being recessed in the radially inner portion of said clip body substantially opposite the radially outer portion of said clip body midway between said clamping arms.

23. The improved finishing wheel of claim 22 further characterized in that said link member is a single, unitary, integrally-formed piece of yieldable material and at least one of said first and second head portions is adapted to be removeably retained within its respective slot for facilitating easy replacement of worn pack units.

24. The improved finishing wheel of claim 16 further characterized in that each of said first and second quasi-cylindrical head portions includes an elongated reenforcing rod centrally disposed therein with the longitudinal axii of said rods being parallel to said slot axii.

25. The improved finishing wheel of claim 24 further characterized in that each of said rods is a solid rigid member and the quasi-cylindrical head portion encircling each of said rods is a yieldable material affixed tightly thereto, said intermediate portion of said link member being of the same yieldable material and being integral with said head portions to define a unitary, re-enforced link member.

* * * * *